United States Patent [19]

Stemmle

[11] Patent Number: 4,558,860

[45] Date of Patent: Dec. 17, 1985

[54] SINGLE PIVOT BIN SORTER

[75] Inventor: Denis J. Stemmle, Webster, N.Y.

[73] Assignee: Xerox Corporation, Stamford, Conn.

[21] Appl. No.: 615,005

[22] Filed: May 29, 1984

[51] Int. Cl.[4] ..... B65H 39/11; B65H 31/24

[52] U.S. Cl. ..... 271/293; 271/294

[58] Field of Search ..... 271/293, 287, 288, 289, 271/290, 292, 293, 294, 297, 298, 305

[56] References Cited

U.S. PATENT DOCUMENTS

| | | | |
|---|---|---|---|
| 3,414,254 | 12/1968 | Snellman et al. . | |
| 3,788,640 | 1/1974 | Stemmle . | |
| 3,851,872 | 12/1974 | Gerbasi . | |
| 3,944,207 | 3/1976 | Bains | 270/58 |
| 3,977,667 | 8/1976 | Cross et al. . | |
| 4,015,841 | 4/1977 | Mitsumasu . | |
| 4,055,339 | 10/1977 | Looney . | |
| 4,073,118 | 2/1984 | Weber et al. | 53/23 |
| 4,274,624 | 6/1981 | Sato et al. | 271/292 |
| 4,328,963 | 5/1982 | DuBois et al. | 271/294 X |
| 4,332,377 | 6/1982 | DuBois et al. | 271/293 |
| 4,397,461 | 8/1983 | DuBois et al. | 271/293 |
| 4,398,712 | 8/1983 | George | 271/293 |

FOREIGN PATENT DOCUMENTS

| | | | |
|---|---|---|---|
| 0061558 | 5/1980 | Japan | 271/297 |
| 0061559 | 5/1980 | Japan | 271/297 |

*Primary Examiner*—Bruce H. Stoner, Jr.
*Assistant Examiner*—Lawrence J. Goffeny, Jr.

[57] ABSTRACT

A sorting apparatus which has a nest of a plurality of sheet receiving bins supported on a sorting support frame, each bin with a sheet output end and a sheet input end, the plurality of bins being pivotally mounted at their output end about the same pivot point on the support frame such that the output end of each bin is at a level higher than its input end so that the bins slope upwardly for uphill stacking of sheets as they are inserted. The bins are spaced relatively close together at the input end and relatively far apart at the output end. The apparatus is also provided with a rotary shifting member to sequentially pivot the bins about their pivoting mount to index the bins past the fixed feed throat for sheet insertion and as the bins are indexed past the fixed feed throat the rotary shifting member widely spaces adjacent bins to provide sheet entry for successive bins when positioned opposite the feed throat while the input ends of the bins are nested close together on either side of the sheet entry.

10 Claims, 11 Drawing Figures

SINGLE PIVOT BIN SORTER

CROSS REFERENCE TO RELATED APPLICATIONS

Reference is hereby made to copending application Ser. No. 363,732, entitled "Sorter for Collating Sheets into Sets", filed Mar. 30, 1982, in the name of Johannes Lap and to application Ser. No. 363,731, entitled "Sorter for Collating Sheets into Sets", filed Mar. 30, 1982, in the name of Franciscus V. Jacobs both of which are commonly assigned to the assignee of the present invention.

BACKGROUND OF THE INVENTION

This invention relates to sorting apparatus for collating sheets into sets and is particularly adapted for use, although not exclusively, with or as part of an office reproduction machine.

Automatic reproducing apparatus, and in particular office copiers, have the capability of producing a plurality of copies of an original document or other information. In many applications for such office copiers, it is desirable to produce collated sets of copies of the original multipaged document. The collation of the individual copies made in such office copiers into sets is achieved with the utilization of a sorter which generally comprises a plurality of bins wherein each bin is designed to collect one set of copies of the original document. A variety of sorters are well known in the art. Most sorters commercially used with office copiers comprises a plurality of tray members which are spaced apart and extend in an array which may be horizontal, as for example, in U.S. Pat. Nos. 3,944,207 and 4,015,841 or vertical as in U.S. Pat. No. 3,977,667. There are also traveling gate sorters as described, for example, in U.S. Pat. No. 3,414,254 in which sheets are conveyed by a sheet transport past the openings of a vertical array of bins and a movable gate or feed throat traverses across the bin openings for deflecting the sheets into the respective bins in turn. Another type of sorter has fixed bins and a deflector or gate associated with each bin and as a sheet transport advances the copy sheets past the bin openings, deflectors are actuated in turn to guide the sheets from the transport into respective bins. In moving bin sorters such as described in U.S. Pat. Nos. 3,788,640 and 4,055,339, the bins themselves are indexed past a fixed throat to facilitate sheet insertion in the sorter. Rotary sorters having bins extending radially outwardly through an axis of rotation are also shown, for example, in U.S. Pat. No. 3,851,872 and in U.S. Pat. No. 4,073,118 wherein a fan-like array of bins is indexed past a fixed feed throat.

It is generally desired to make the sorting apparatus as simple and as compact as possible. Thus, for any given capacity the bin should be preferably be completely filled. However the capacity of the bins is limited by the space required over the stack for insertion of the final sheets in each of the bins. To alleviate this difficulty it is known from various of the above mentioned patents that the bin entrance openings of the respective bins may be selectively increased in size by relatively moving the bin plates to enlarge the opening as a sheet is fed into it.

An additional sheet sorter wherein individual bin plates are arranged in a fan-like array is that described in U.S. Pat. No. 4,398,712 wherein a plurality of movable sheet receiving bins is attached to a quadrant plate for indexing the input ends of the bins past a fixed feed throat to align the bin openings in line with the feed throat for sheet insertion. The bin plates are arranged in a vertically oriented fan-like array and the quadrant plate is rotatable about an axis. U.S. Pat. No. 4,397,461 describes a downhill sorter wherein the input ends are indexed past the sheet entry location by a rotary shifting member, such as a Geneva wheel, which engages individual bin locating rods to transport the input ends of the bins from one side of the feed throat to the feed throat to the other side of the feed throat. The end of the individual bins opposite the input end are each individually pivotally mounted about separate pivot points in the sorting frame. While capable of generally satisfactorily accomplishing the sorting operation, this apparatus suffers from at least two deficiencies. Like all downhill sorters, it is somewhat limited in the range of sizes of copy paper that may be used, inasmuch as small copy paper will tend to go directly to the end of the bin and frequently block the insertion of subsequent sheets into the bin. Furthermore the power requirements to index the multipivot bins is substantial.

An alternative to the downhill stacking arrangement shown in U.S. Pat. No. 4,397,461 is the uphill sorting or stacking arrangement described in U.S. Pat. No. 4,332,377. In this sorter a plurality of trays are mounted to be indexed by a rotary shifting member, such as a Geneva wheel, progressively past a fixed sheet entry position. The input ends of the bins are supported by pins which slidingly move in guiding slots. The remote ends of the bins are freely supported one on the other for relative longitudinal and pivotal movement.

SUMMARY OF THE INVENTION

In accordance with a principal aspect of the present invention, a sorting apparatus comprising a support frame and a nest of a plurality of sheet recieving bins, each bin with a sheet output end at one end thereof and an input end at the other end thereof, each of said bins being pivotally mounted about its output end about the same pivot point in the support frame such that the output end of each bin is at a higher level than the input end so that the bins slope upwardly from the input end to the output end thereby providing uphill stacking of individual sheets is provided. The bins are spaced relatively close together at the input end and spaced relatively far apart at the ouput end and the apparatus includes means to sequentially pivot the bins about their mounting pivot and index the input end of each of the bins past a fixed feed throat to facilitate insertion of a sheet into each bin. The indexing means sequentially moves the bins from one side of the feed throat to a position opposite the fixed feed throat to the other side of the feed throat, and provides means to widely space apart adjacent said bins to provide a sheet entry for successive bins when positioned opposite said fixed feed throat with the input ends of the bins being nested close together on either side of the sheet entry.

In a further aspect of the present invention, each bin includes a bin engaging tab at at least one side of the input end of the bin and the bin indexing means comprises a driven rotary shifting member having a recess therein to engage the bin engaging tab and upon rotation, rotate the tab and the input end of the bin past the fixed sheet insertion throat while widely spacing the successive bins when opposite the sheet insertion throat.

According to another aspect of the present invention, the driven rotary shifting member comprises a motor and a C-cam which engages tabs on each of the bins or a Geneva wheel which engages circular shaft members on each of the bins.

In a further aspect of the present invention, the rotary shifting member is capable of moving in both directions to thereby provide bidirectional sorting.

In a further aspect of the present invention, each of the bins are open at both sides and the output end thereby permitting manual removal of the sorted sheets from both sides and the output end of the apparatus.

In a further aspect of the present invention, each of the bins is provided with side plates, the top bin side plate covering the lower side plates thereby enclosing the sides of the sorting apparatus.

In a further aspect of the present invention, spring means is provided to spring bias a nest of bins upward against the rotary shifting member.

Accordingly it is an object of the present invention to provide an improved sorting apparatus.

It is an additional object of the present invention to provide a sorting apparatus for use with electrostatographic reproducing apparatus wherein the spacing between adjacent bins near the processor is compact and the spacing at the other end is wider and sufficient to provide manual extraction of the sheets from the individual bins.

It is an additional object of the present invention to provide an improved uphill sorter.

It is a further object of the present invention to provide a sorter which permits the operator to access the bins from three sides to facilitate operator convenience in removing sorted sheets.

Is is an additional object of the present invention to provide a simple, relatively inexpensive, compact sorting apparatus.

It is a further object of the present invention to provide a sorting apparatus requiring minimum power to function.

BRIEF DESCRIPTION OF THE DRAWINGS

For a better understanding of the invention as well as other objects and further features thereof, reference is had to the following drawings and descriptions.

DESCRIPTION OF THE PREFERRED EMBODIMENT

Figure 1:
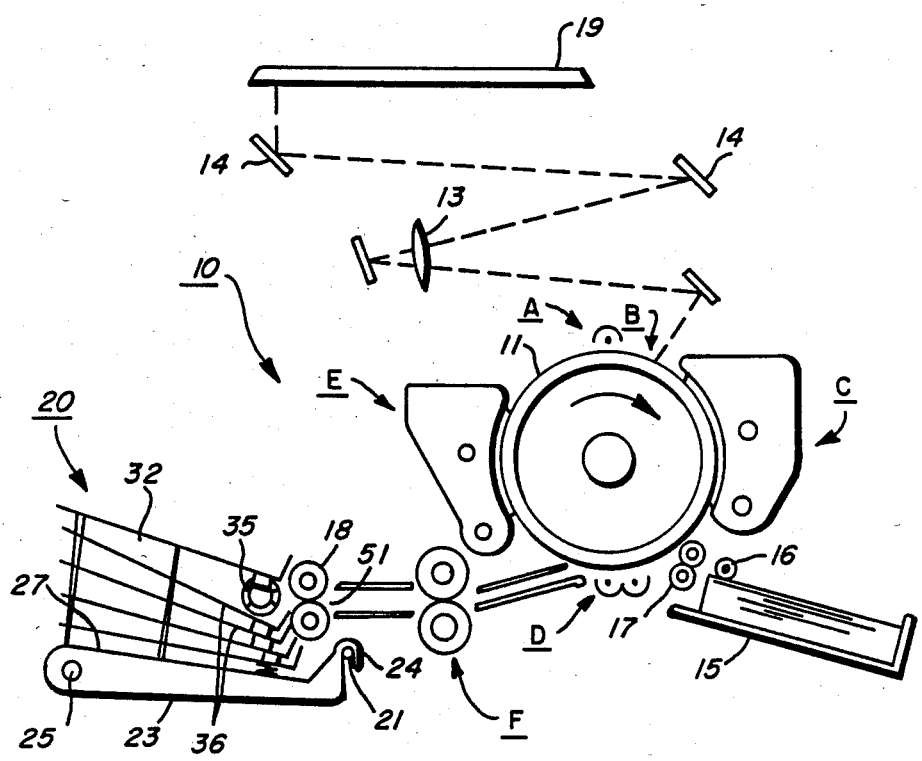
FIG. 1 is a schematic cross-section of a xerographic copier having a preferred embodiment of the sorting apparatus according to the present invention.

Referring to FIG. 1, there is shown an automatic xerographic reproducing machine 10 having attached thereto a sheet sorter 20 according to this invention for collecting copy sheets produced in machine 10. Although the present invention is particularly well suited for use in automatic xerographic apparatus 20 it is equally well adapted for use with any number of devices in which cut sheets of material are delivered serially for collating into sets.

The processor 10 includes a photosensitive drum 11 which is rotated in the direction indicated by the arrow so as to pass sequentially through a series of xerographic processing stations; a charging station A, an imaging station B, a developer station C, a transfer station D, and a cleaning station E.

A document to be reproduced is placed on a platen 19 and scanned by means of a moving optical system including a lens 13 and mirror 14 to produce a flowing light image on the drum surface having been charged at A. Then the image is developed at C to form a visible toner image. Cut sheets of paper are moved into transfer station D from an elevating registering apparatus 17 in synchronous relation with the image on the drum surface. Following transfer, the copy sheet is stripped from the drum surface and directed to a fusing station F. The drum surface itself continues past the cleaning station E at which residual toner remaining on the drum surface is removed prior to the drum surface again being charged at A. Upon leaving the fuser, the fixed copy sheet is passed to the processor output rolls 18 which are immediately next to or may form the input to the sorter 20. As will be apparent from the machine geometry illustrated in FIG. 1, the copy sheets are conveyed to the sorter 20 face-up.

Figure 2:
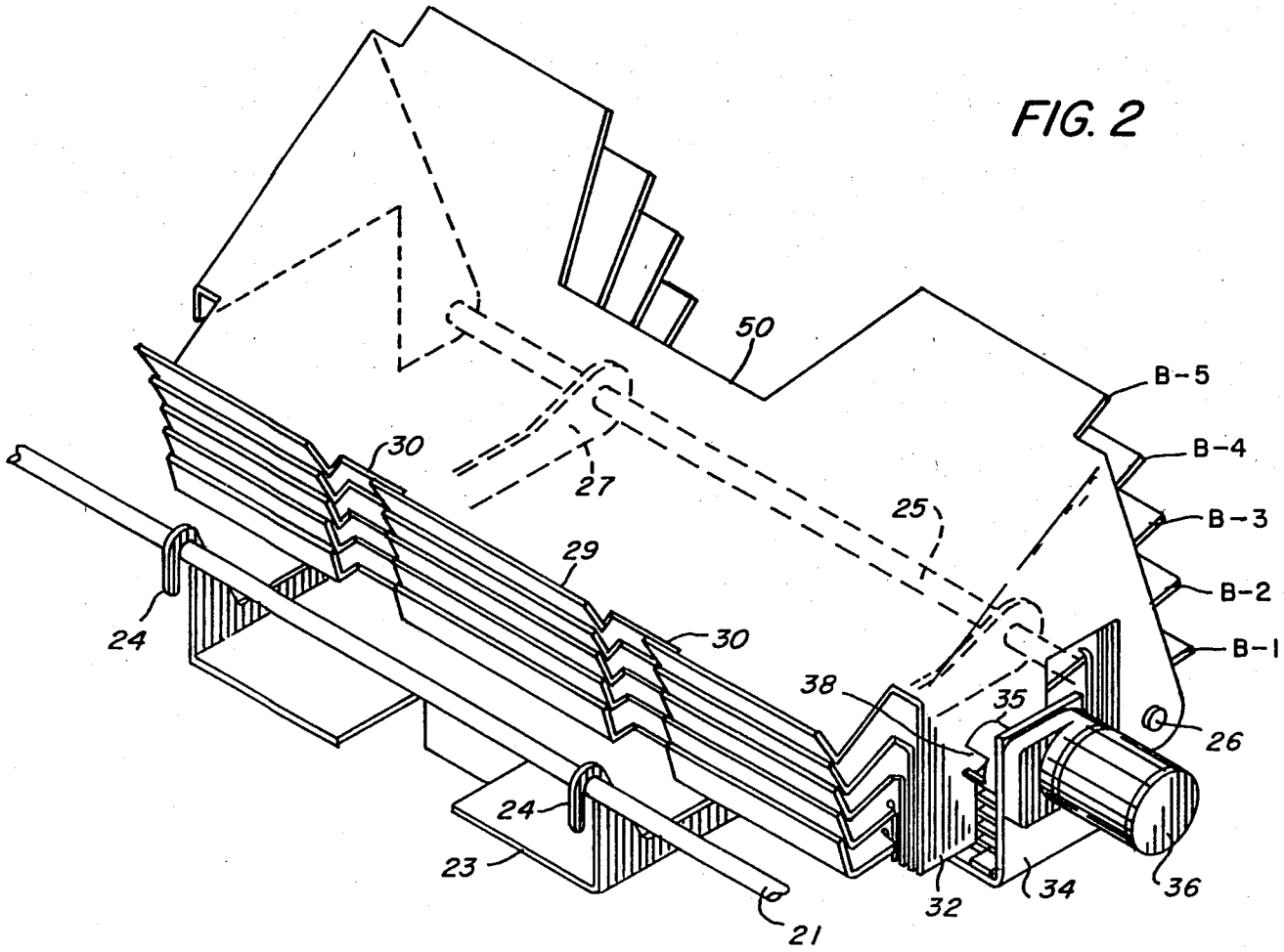
FIG. 2 is an isometric view from the front of the pivoting bin sorter according to the present invention.
Figure 3:
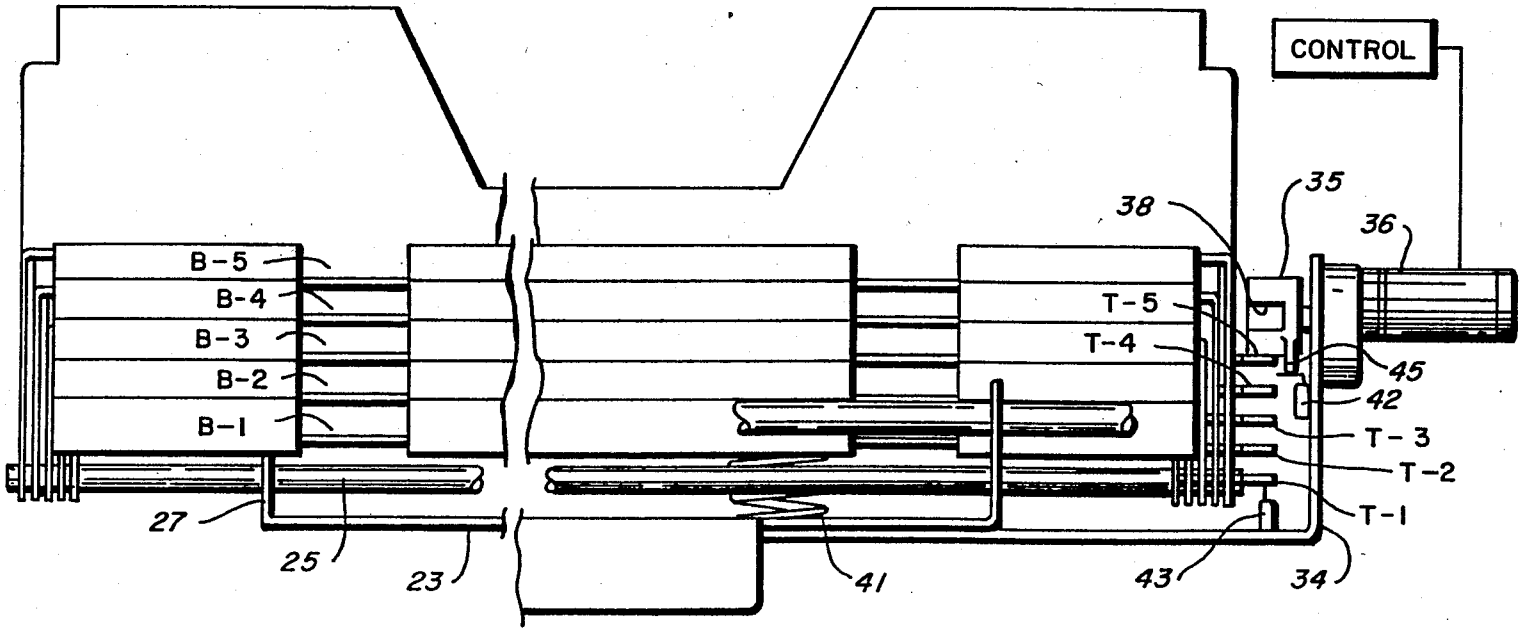
FIG. 3 is an end view of the pivoting bin sorter according to the present invention illustrating in greater detail the indexing mechanism.
Figure 4:
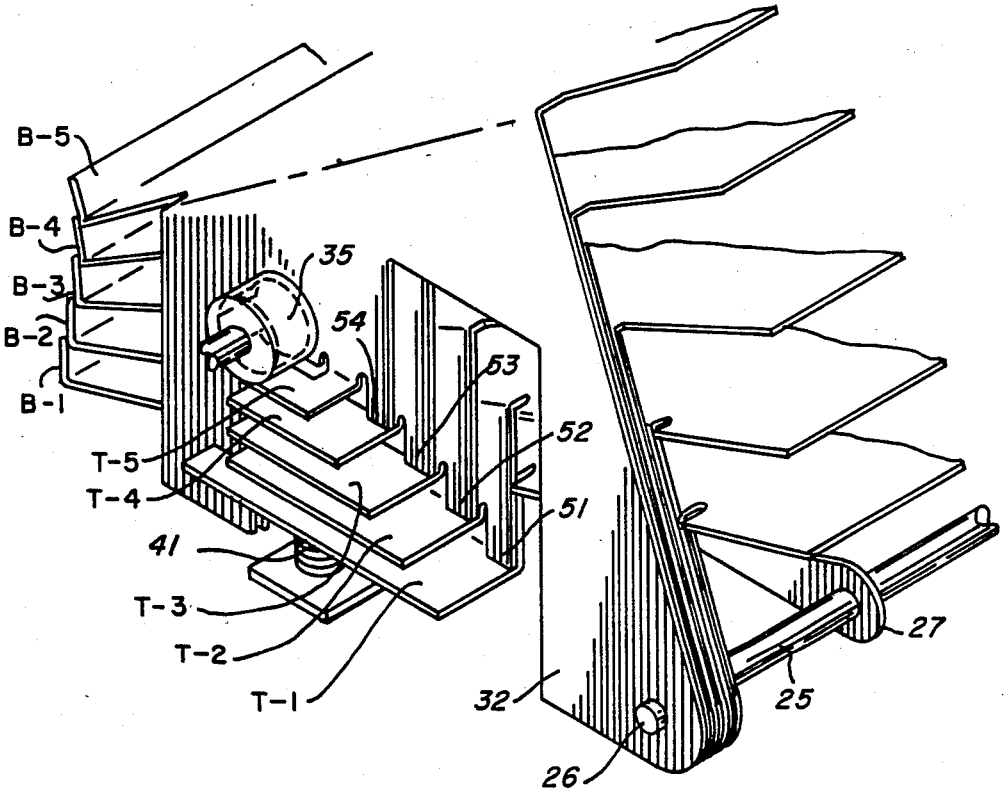
FIGS. 4 and 5 are alternative enlarged views of a C-cam indexing mechanism according to the present invention.

With continued reference to FIG. 1 and additional reference to FIGS. 2, 3 and 4, the sorter of the present invention is illustrated as comprising five sheet receiving bins B1 through B5. The bins are supported by a support frame 23 which at both sides has a bin pivot pin arm 27 attached thereto. Each of the individual trays B1 through B5 are pivotally mounted about bin pivot pin 25 with the bin pivot cap 26 being fastened to the bin pivot pin 25 on the outside cover 32 of the uppermost bin B5. At the other end of the support frame 23 is a processor mount 24 here illustrated as a pair of hooks which are adapted to engage the copier machine frame mount supports 21 (see FIG. 1.). Each of the bins is equipped with bin side cover 32 as well as a bin back stop lip 29 against which a sheet, once inserted in the bin, can fall by gravity back against registering the trail edge thereof. In addition as illustrated, each of the bins, B1 through B5, has a cut-out portion in the bin back stop lip 29 providing a clearance gap 30 for engaging with the nip exit rolls 18 of the office copier. As may be clearly illustrated with particular reference to FIG. 2, bins B1 through B5 are arranged in a nest-like arrangement wherein they are each pivotally mounted about the same bin pivot pin 25 such that the output end of each bin is at a level higher than its input end so that the bins slope upwardly from the input end to the output end providing an uphill stacking of the individual sheets as they are inserted in each of the bins. Once inserted in this uphill orientation, the individual sheet in a bin will readily fall by gravity registering the trailing edge thereof against the back stop lip 29. Furthermore with this arrangement the bins being pivoted about the rear or output end of each bin, the bins can be arranged to be spaced relatively far apart at the output end thereby readily facilitating manual withdrawal of collated sheets from the individual bins. In this regard attention is again directed to FIG. 2 wherein each of the bins is provided with an extraction opening 50.

Referring once again to FIG. 2, at the input end of the bins, the bins are illustrated here in the home position wherein they are spaced relatively close together ready for indexing past the fixed feed throat, which will be hereinafter described in greater detail. This provides a relatively small machine volume for attachment or insertion to the office copier. Thus at the rest position, as illustrated in FIG. 2, the clearance gap 30 in topmost bin B5 will be in operative engagement with the nip exit rolls 18 of the office copier.

The indexing mechanism will be described with particular reference to FIGS. 2 and 4 and additional reference to FIGS. 1 and 3. The nest of bins, B1 through B5, is continuously urged upwardly against the bottom of the indexing means 35 by means of spring 41 (see FIG. 3). As will be appreciated hereinafter this biasing mechanism provides continuous force for the indexing mechanism to index one bin upwardly on each complete rotation thereof. The indexing mechanism is mounted on index mount 34 and is illustrated herein as comprising a C-cam 35 driven by reversable DC motor 36. As the indexing mechanism here illustrated as a driven rotary shifting member such as C-cam 35 having an engagement slot 38 therein, rotates in a counterclockwise direction the engagement slot 38 engages the top most indexing tab T5 which is fastened to the topmost bin B5. Since the bins are biased upwardly against the C-cam, the indexing tab readily falls within open engagement slot 38. On continued rotation of the C-cam in a counterclockwise direction, the indexing tab T5 is raised upwardly thereby pivoting bin B5 about bin pivot pin 25 and opening the space at the input end of the bins between B5 and B4 so that a copy sheet may be driven by processor nip exit rolls 18 into bin B4. The bins in addition to being provided with indexing tabs, T1 through T5, are also provided with spacing elements S1 through S4 of any suitable size to provide spacing between adjacent bins when in the home closed or nesting position. On continued rotation, the indexing C-cam 35 and C-cam slot 38 will engage successive tabs, T5 through T1, thereby raising the individual bins sequentially upward so that the second from bottom bin B2 finally rests on the top of the solid portion of the C-cam 35. As illustrated in FIG. 4, tab T1 is longer than the other tabs so that it will not be engaged by slot 38. This prevents the bottom bin B1 from moving across the input gap since it always stops below the input gap to receive sheets. In the embodiment illustrated in FIG. 4, the spring force provided by spring 41 from the bottom of the bin B1 transmits a force to bin B2 by the geometric spacer S1 on the bin walls. It subsequentially transmits a force to bin B3 through another geometric spacer S2 on that bin and to B4 through another geometric spacer and so on to bin B5. The slot 38 in the C-cam 35, when rotated to the bottom, engages the indexing tab of the next adjacent bin and lifts the bin across the sheet input entry so that gravity holds the bin against the top of the C-cam.

In operation with the nest of bins, B1 through B5, in the home position and with the topmost bin B5 being below the exit of nip rolls 18 of the office copier a sheet may be fed over the back stop lip 29 of bin B5 into bin B5. As the sheet travels through the nip exit rolls 18 the trailing edge of the sheet is identified by a jam switch 51 in the office copier (see FIG. 1) which starts a time delay in the sorter control after which delay the sorter control activates the reversable DC motor 36 on which the C-cam 35 rotates, rotating the C-cam from the neutral position so that the slot 38 in the C-cam is facing toward the machine whereby the top indexing tab, T5 of bin B5, is engaged by the slot 38 and inserted in the slot 38 as the C-cam 35 rotates. The tab, T5, is lifted to the top of the C-cam 35 as it rotates counterclockwise and finally rides on the outside surface of the C-cam when positioned at the top of the C-cam. Meanwhile the next adjacent bin, B4 below is being urged upwardly against the bottom of the C-cam by spring 41. After one revolution of the C-cam switch 42 activated by a lobe 45 on the C-cam shuts motor 26 off. The sorter is then in position for the next sheet to be sorted or inserted. Once again the trailing edge of the sheet is sensed by jam switch 51 activating the time delay after which motor 36 is once again activated, rotating the C-cam 35 so that slot 38 and engages tab T4 of bin B4 indexing the second bin B4 upwardly to the top of the C-cam. Once again the next adjacent bin B3 is being urged upwardly by spring 41 in engagement with C-cam. In a similar fashion the remaining bins in the nest of bins are indexed in an upward direction until all but the bottommost bin have been indexed upwardly and rest by gravity on the top of the C-cam. The indexing tabs for engagement with the C-cams are ideally located tangential to the C-cam at the bottom of the C-cam rotational path. If desired, the sorting apparatus can be used to operate either in a unidirectional manner as indicated above or it can be operated in bidirectional manner, sorting sheets as the individual bins are indexed both upward and downward. Sorting with the individual bins being indexed downward is accomplished through the same mechanism with the C-cam together with its engagement slot 38 rotating in a clockwise direction to engage initially tab T2 on bin B2 thereby forcing the bin B2 downwardly against bin B1 and thereby against the force of spring 41. In a similar manner the remaining bins may be indexed downwardly to provide this bidirectional sorting capability. Once in the home position with all bins having been indexed below the C-cam, switch 43 (see FIG. 3) is engaged thereby telling the machine sorter control that the bins are in the home position, and are ready to be indexed in an upwardly direction.

Figure 5:
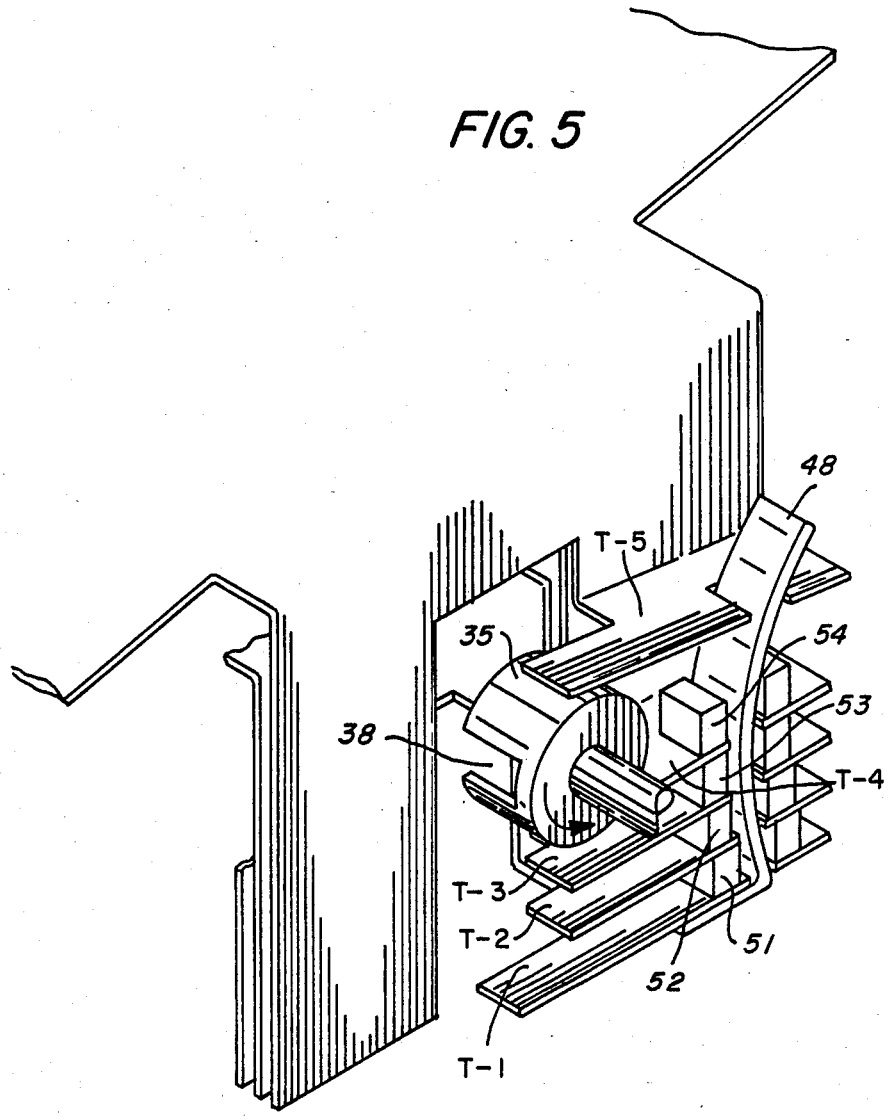

FIG. 5 illustrates an alternative embodiment in which the bin gap spacing may be adjusted with individual spacers S1–S4 placed between the successive indexing tabs, T1 through T5. The spacers need not be attached specifically to the bins and the spacing between individual bins can be readily increased or decreased merely by changing the size of the spacers thereby altering the individual bin capacity. As the bins are indexed by the C-cam 35 the spacers are guided in place by spacer guide 48 which is firmly attached to the lowermost bin B1. The entire indexing mechanism is comparatively small and can be readily covered with, for example, a plastic molded cover 40 which together with the side plates provide a suitably enclosed sorting apparatus without the use or necessity of providing separate covers.

Figure 7:
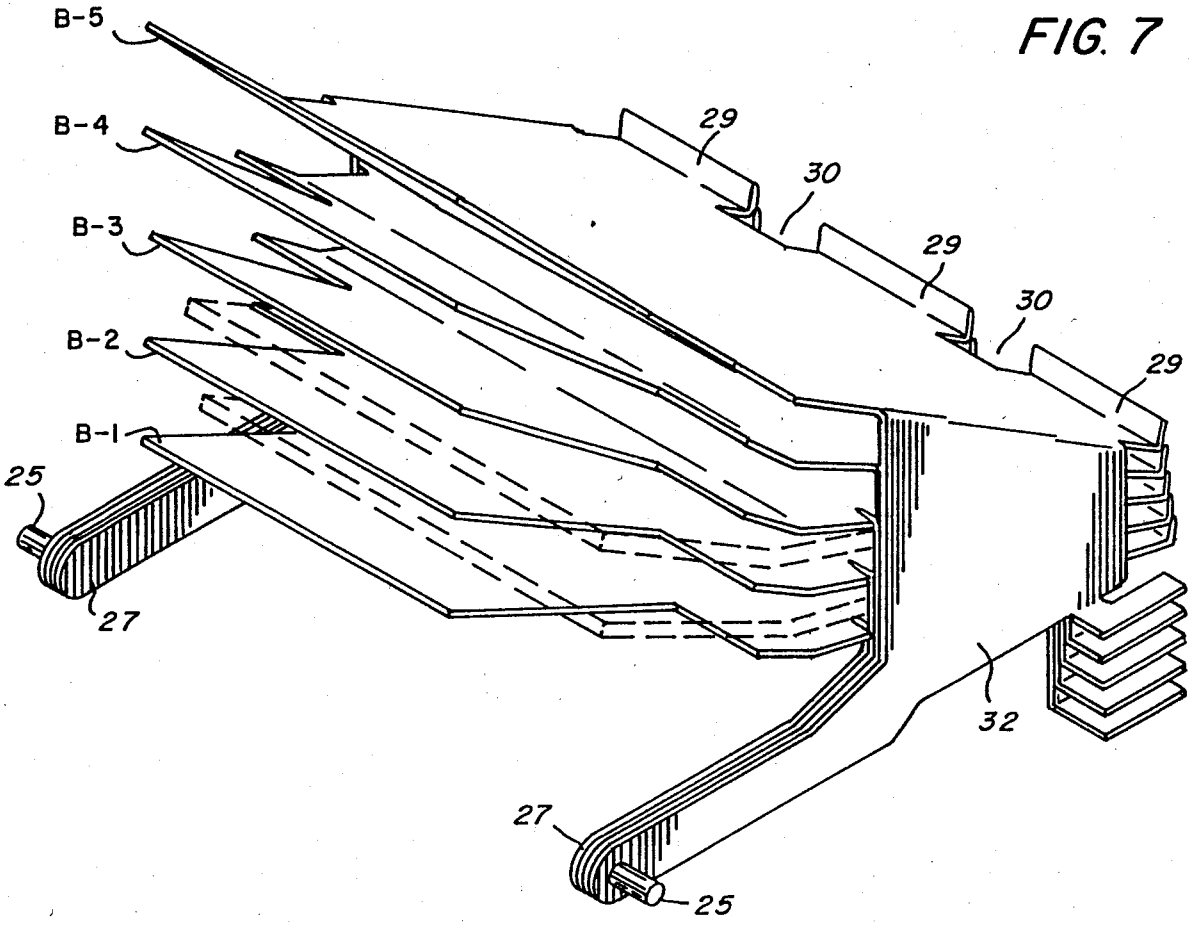
FIG. 7 is an alternative embodiment of the present invention wherein the individual bins are open at both sides and the output end of the sorter thereby permitting manual removal of sorted sheets from both sides and the output end of the apparatus.

On the other hand FIG. 7 illustrates an alternative embodiment wherein the same general concepts are used except that the individual bins are designed such that they are opened at the major portion of both sides and at the output end thereby permitting manual removal of sorted sheets from both sides in the output end of the apparatus.

Figure 8:
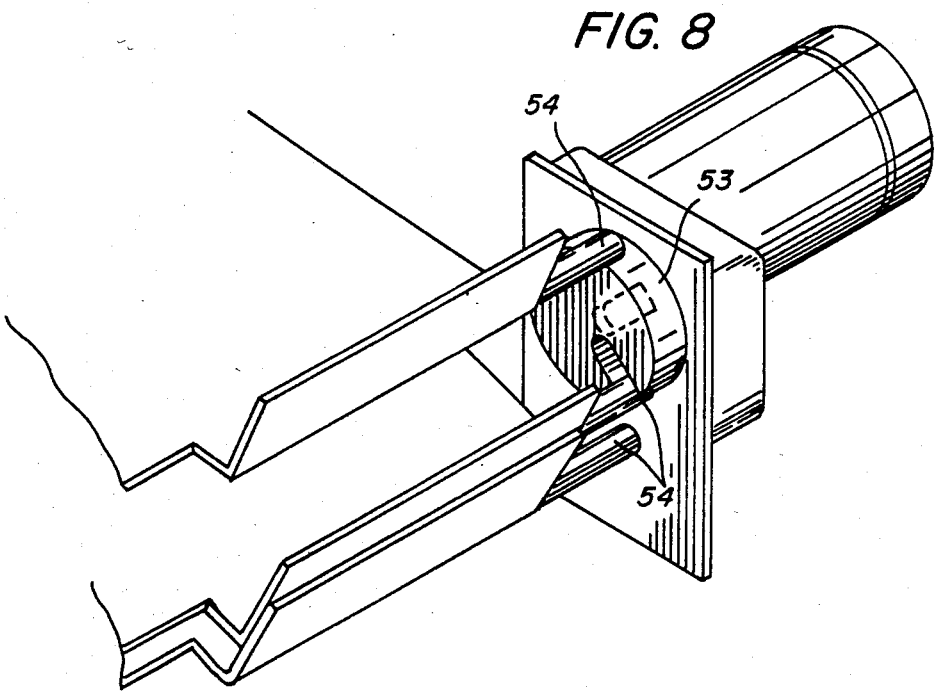
FIG. 8 is an alternative enlarged view of a Geneva indexing mechanism.

A further alternative arrangement for the indexing mechanism is illustrated in FIG. 8. Here instead of a slotted C-cam a combination of a Geneva wheel 53 together with an indexing pin 54 on each of the bins, B1 through B5, is provided to index the bins upwardly and downwardly in the manner previously described.

The sorting apparatus according to the present invention, provides an uphill sorting device wherein copy sheets of virtually any size, not larger than the bin, may be sorted and after each sheet is inserted the trailing edge registered against the bin back stop on each of the bins. The geometric mounting arrangement and spacing provided permits wider bin spacing at the output end thereby permitting easy access and enhanced usability with extraction of the sheets by the operator while at the same time minimizing the spacing near the processor by providing a compact nesting arrangement which may be fanned out between successive bins only for sheet insertion. Furthermore the rear pivoting arrangement permits the selection of any suitable bin opening thereby facilitating operator convenience and satisfaction when extracting sheets from the bin and further enabling access to the bin from three sides. The design permits a wider spacing between bins at the output end of the sorter which ensures that the operator can distinguish adjacent sorted sets of sheets in adjacent bins, as well as provide a sufficient gap between bins for the operator to insert his fingers and grasp the individual sorted sets. In addition, the single pivot design enables a pin or tab to be positioned so that it swings through the same arc for all bins thereby contacting the indexing device in the same positions regardless of which bin is being indexed. This allows the use of a smaller more efficient Geneva mechanism and enables the use of a C-cam.

Figure 9:
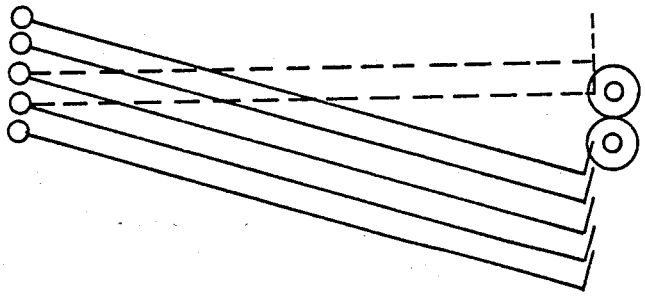
FIG. 9 is a schematic representation of a bin sorter where the bins have vertically assembled pivot points and which illustrates the interference of adjacent bins.
Figure 10:
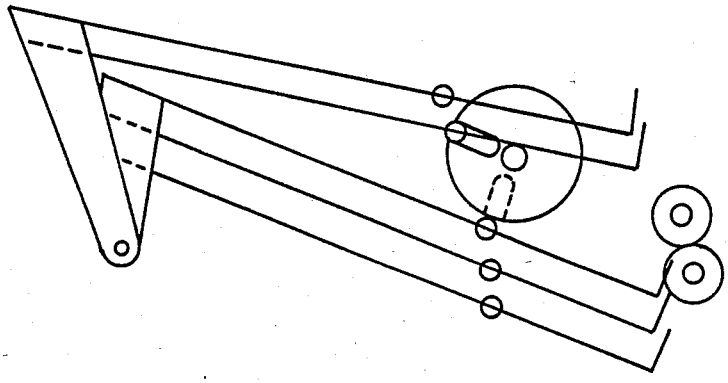
FIG. 10 is a schematic representation of a bin sorter according to the present invention wherein the bins have a common pivot point.
Figure 11:
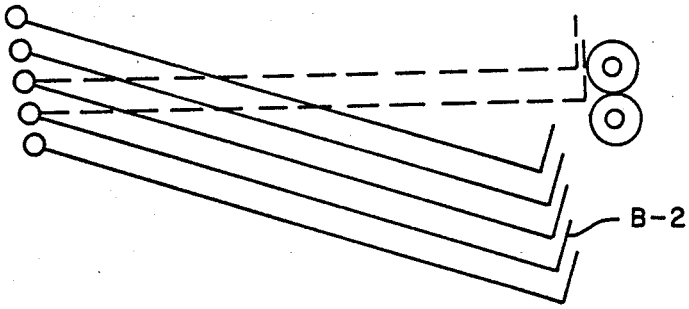
FIG. 11 is a schematic representation of a bin sorter with the pivots arranged so that the bin back stops do not interfer with one another.

The sorting apparatus of the present invention has three principal advantages in the uphill configuration illustrated when compared to sorters having distributed pivot points. With the sorter having distributed pivot points the bin back stops interfere with one another as each bin swings through a separate arc about its own pivot. This is illustrated in FIG. 9 wherein in the upper positions the back stops are noted to interfer on adjacent bins. By contrast, as illustrated in FIG. 10, for an uphill sorter with all bins having a common pivot point the clearance between back stops remains constant in any position. While it is possible to arrange the distributed pivots such that the bin back stops do not interfer with one another as shown in FIG. 11, with this arrangement the bin back stops vary substantially in positional relationship with the nip rolls causing unreliable paper handling performance. In FIG. 11, for example, the arc traveled by the bin B2 back stop determines the position of the nip roll. The paper accumulated in bin B2 must pass by the nip roll without interference as it moves across the sheet input gap. However in order to prevent adjacent back stops from interferring in the upper positions, the back stop of bin B5 must be positioned too far away from the nips for reliable insertion of the trail edges of incoming sheets into that bin. Thus with distributed pivots, the unique sweep paths for the back stops of each bin result in either back stop interference between adjacent bins or unreliable paper handling in some bins. Furthermore with a distributed pivot design the variation in interfaces between the separate bins and the indexing mechanism is intolerable. With a common pivot design the entrance and exit position of the drive pin relative to the Geneva mechanism or the tab relative to the C-cam for each bin can be identical since all bins sweep through the same arc. This enables the use of either a Geneva mechanism or a C-cam to provide an optimized interface for indexing the bins.

Figure 6:
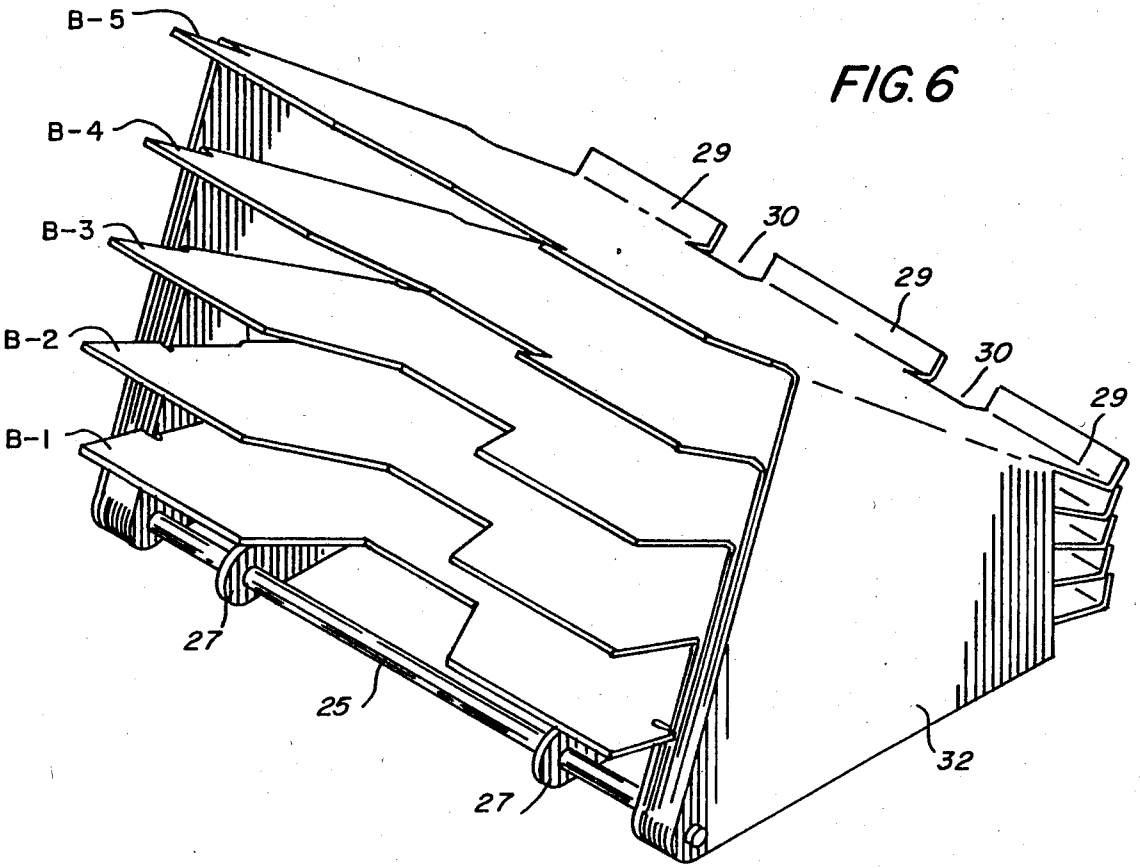
FIG. 6 is an isometric view from the rear of one embodiment of the sorter according to the present invention wherein the top bin provides the side covers for the sorter.

In addition with a single pivot point, manufacturing is to a large extent inherently cheaper in that only one pin pivot need be provided instead of the customary 10 or 20 depending on the number of bins to be used. Furthermore the mounting arrangement is inherently cheaper which is an imporant factor considering the design of small personal convenience copiers. Furthermore with the nesting arrangement indicated every individual bin assembly may be optimized from a geometric standpoint to minimize the power required to index the bins during loading thereby insuring high reliability of the sorting apparatus. In addition the sorting apparatus described may be used with the total paper path provided within the office copier thereby accepting the sheet fed directly from the office copier into the bins without requiring additional sheet transport mechanisms. The embodiment illustrated in FIG. 6 furthermore provides a design and structure wherein functional bin plates together with their pivoting members provide a substantially enclosed aesthetically pleasing appearance without the use of a substantial number of covers together with the necessary mounts and hinges to support those covers. Finally, with all of the bins being optimized from a geometric standpoint relative to each other and to their interface and location a compact nest of bins wherein each is placed one within the other is provided.

All the patent applications and patents referred to herein are hereby specifically incorporated in their entirety into the instant specification.

While specific embodiments of the present invention have been described above, it will be understood that various modifications may be made to the specific details referred to herein without departing from the scope of the invention as defined in the appended claims. For example, while the indexing mechanism has been illustrated with regard to a driven rotary shifting member and in particular a C-cam or Geneva wheel, it should be understood that any kind of indexing mechanisms could be used. For example, various arrangements or devices using solenoids together with plungers could be devised for this purpose. It is intended that such alternatives and modifications and others as may be readily apparent to the artisan may come within the scope of the appended claims.

What is claimed is:

1. Sorting apparatus comprising a support frame, a nest of a plurality of sheet receiving bins, each bin with a sheet output end at one end thereof and an input end at the other end thereof, each of said plurality of bins being pivotally mounted at its output end about the same pivot point on said support frame such that the output end of each bin is at a level higher than its input end so that the bins slope upwardly from the input end to the output end thereby providing uphill stacking of individual sheets as they are inserted in each of the bins, said bins being spaced relatively close together at the input end and being spaced relatively far apart at the output end, means to sequentially pivot the bins about their mounting pivot and index the input end of each of said bins past a fixed sheet feed throat to facilitate insertion of a sheet into each bin, said indexing means sequentially moving said bins from one side of the feed throat to a position opposite the fixed sheet feed throat to the other side of the feed throat, said indexing means widely spacing apart adjacent said bins to provide a sheet entry for successive bins when positioned opposite said fixed feed throat, said input ends of said bins being nested close together on either side of said sheet entry.

2. The sorting apparatus of claim 1, wherein each said bin includes a bin engaging tab at at least one side of the input end of said bin and said bin indexing means comprises a driven rotary shifting member having a recess therein to engage said bin engaging tab and upon rotation rotate said tab and the input end of said bin past the fixed sheet insertion throat while widely spacing the successive bins when opposite said sheet insertion throat.

3. The sorting apparatus of claim 2, wherein said driven rotary shifting member comprises a C-cam and a motor.

4. The sorting apparatus of claim 2, wherein said driven rotary shifting member comprises a Geneva wheel and said bin engaging tab comprises a circular shaft for insertion in said recess.

5. The sorting apparatus of claim 2, including means to drive said rotary shifting member in both directions to thereby provide bidirectional sorting.

6. The sorting apparatus of claim 2, including spring means between said support frame and said nest of bins to spring bias said bins upward against said rotary shifting member.

7. The sorting apparatus of claim 1, including means to attach said apparatus to the sheet output delivery station of an automatic reproducing apparatus.

8. The sorting apparatus of claim 1, wherein each bin includes a sheet back stop at the input end over which a sheet may be inserted when opposite the sheet delivery throat and against which a sheet once inserted in the bin can fall by gravity registering the trailing edge thereof.

9. The sorting apparatus of claim 1, wherein each of said bins is provided with side plates, the top bin side plate covering the lower bin side plates thereby enclosing the sides of said sorting apparatus.

10. The sorting apparatus of claim 1, wherein each of said bins are open at both sides and the output end thereby permitting manual removal of sorted sheets from both sides and the output end of the apparatus.

* * * * *